United States Patent [19]

Calderon

[11] 4,213,828

[45] * Jul. 22, 1980

[54] METHOD AND APPARATUS FOR QUENCHING COKE

[76] Inventor: Albert Calderon, 1065 Melrose, Bowling Green, Ohio 43402

[ * ] Notice: The portion of the term of this patent subsequent to Feb. 22, 1996, has been disclaimed.

[21] Appl. No.: 804,364

[22] Filed: Jun. 7, 1977

Related U.S. Application Data

[63] Continuation-in-part of Ser. No. 757,074, Jan. 5, 1977.

[51] Int. Cl.[2] ..... C10B 33/00; C10B 39/04; C10B 39/14

[52] U.S. Cl. ..... 201/39; 202/228; 202/253; 202/263; 202/227

[58] Field of Search ..... 201/39; 202/95, 227, 202/228, 253, 263; 110/171; 432/85; 266/46, 259

[56] References Cited

U.S. PATENT DOCUMENTS

| | | | |
|---|---|---|---|
| 755,154 | 3/1904 | Moore | 202/227 |
| 2,795,539 | 6/1957 | Hughes | 202/228 |
| 3,536,592 | 10/1970 | Scharbrough et al. | 201/39 |
| 3,748,235 | 7/1973 | Pries | 202/263 |
| 3,766,018 | 10/1973 | Riechert | 202/227 |
| 3,772,155 | 11/1973 | Knappstein et al. | 202/227 |
| 3,809,619 | 5/1974 | Drebes et al. | 202/227 |
| 3,809,622 | 5/1974 | Knappstein et al. | 202/263 |
| 3,843,461 | 10/1974 | Allen | 202/227 |
| 3,869,352 | 3/1975 | Allen et al. | 202/227 |
| 3,896,556 | 7/1975 | Welter | 201/39 |
| 3,966,563 | 6/1976 | Armour et al. | 202/263 |
| 3,972,780 | 8/1976 | Calderon | 202/227 |
| 3,984,289 | 10/1976 | Sustarsic et al. | 202/263 |
| 4,053,366 | 10/1977 | Holter | 202/263 |
| 4,142,942 | 3/1979 | Calderon | 201/39 |

FOREIGN PATENT DOCUMENTS 875039 4/1953 Fed. Rep. of Germany .

*Primary Examiner*—Bradley R. Garris

[57] ABSTRACT

A method and apparatus for quenching coke which comprises the quenching of the coke in a non-oxidizing atmosphere in a chamber during the push to drop the temperature of the coke below its ignition point for eliminating the emissions of hydrocarbons at the source, confining the steam and vapor for additional quenching within said chamber by virtue of pressure build-up, forcing the steam out of said chamber for direction to condensing means, condensing the steam to eliminate the plume, precipitating particulate matter and dissolving condensables, scrubbing the non-condensables for the removal of sub-micron particulate matter, containing the excess quench water and condensate including the breeze resulting from the quenching and condensing and exchanging the heat from the quench water and condensate for heat recovery.

4 Claims, 8 Drawing Figures

CONDENSATE HOT WARM
COLD WARM BOILER WATER

METHOD AND APPARATUS FOR QUENCHING COKE

RELATED APPLICATION

The present invention relates to the controlling of emissions during the pushing and quenching of coke, and it is a continuation-in-part of my co-pending application filed on Jan. 5, 1977 bearing Ser. No. 757,074.

Various schemes have been presented and tried to control the emissions from the push such as a one-spot car which is enclosed and connected to a dust collection system such as a high energy scrubber car or a car having high pressure hot water for the creation of suction. After the push, both the quench car and the scrubber car are driven to a quenching station and the temperature of the coke is dropped by quenching with water. But in particular, this invention relates to an improvement over the patent issued on Mar. 20, 1973 to Swindeler and numbered 3,721,609 which discloses a quenching car having a vertical fall space into which the coke is pushed from a guide.

At the present time the United States operates about 230 coke oven batteries, most of which are of the 4-meter size; there are about 20 batteries of the 6-meter size. All these batteries possess a coke side bench which is above ground level on which an oven-door extractor runs. At ground level a standard gauge track is disposed for a conventional quenching car. With the pressure applied from EPA and OSHA to contain emissions from the push at the oven, and the quench at the tower, it is of paramount importance to be able to retro-fit the existing batteries wherein the dimensions range from nine to thirteen feet from the oven floor to said track at ground level in the case of the 4-meter batteries and from fifteen to twenty feet from the floor to said track in the case of the 6-meter batteries. The distance between the supporting structure of the bench and wharf into which the quenching car discharges its coke after being quenched, is just enough to permit the running of equipment without too much room to spare. The above-mentioned patent of Swindeler cannot fit within the confines of existing space from the standpoint of height and from the standpoint of width since Swindeler's quenching car necessitates great amounts of height to obtain the fall and a broad gauge track to run on. To excavate and do civil engineering for providing the dimensions needed by Swindeler, would completely disrupt operations.

The reason for companies placing orders for the one-spot car equipped with a scrubber and not the quenching car proposed by Swindeler is because the one-spot car can be retro-fitted within existing clearances. However, the one-spot car mentioned besides needing a high energy scrubber, will require a diesel electric engine for the power generation and use oil for fuel. The noise and the oil-burning diesel are objections because they are new sources of pollution as well as add-on operating costs. Also there are signs that the quenching tower has an emission problem in itself which the one-spot car above-mentioned does not solve, and this emission problem is of great magnitude as evidenced by the report from YORK RESEARCH CORPORATION from Stamford, Connecticut, conducted for EPA under contract.

Other improvements of the instant invention over Swindeler's and the one-spot car equipped with a scrubber will become apparent further in the specification.

These improvements pertain to the elimination of smoke during the push by dropping the temperature of the coke in a non-oxidizing atmosphere in a quenching chamber whose pressure is maintained in the positive for efficient quenching, the forcing of the steam out of said chamber for direction to condensing means, condensing the steam to eliminate the plume, precipitating particulate matter with the condensate and dissolving condensables, scrubbing the non-condensables for the removal of sub-micron particulate matter, containing the excess quench water and condensate to include the breeze resulting from the quenching and condensing for removal, and the efficient method of quenching for uniform coke moisture. Heat recovery from quench water is an added plus.

Since the emissions generated during the pushing and quenching of coke are substantially of three kinds; namely, particulate matter, condensables and non-condensables, it is the main object of this invention to provide an improved method and apparatus which will control these emissions to meet EPA and OSHA standards. The guidelines for emissions from pushing coke are 0.015 and 0.030 pounds per ton of coke pushed and the standards for the quench have not as yet been set since the findings by YORK above-mentioned are fairly recent. There is no reason why the guidelines for emissions from the quench should be less stringent than the guidelines from the push. It is therefore imperative to provide an improved method and apparatus that will fit the prevailing conditions, meet the stringent standards of EPA as well as OSHA without interruption of productivity and without excessive power consumption.

Another object of this invention is to quench the coke in an enclosed chamber and confine the steam and vapor so generated therein in order to build a positive pressure within said chamber and thereby permeate the coke with steam and vapor to further drop the temperature of the coke and also keep oxygen out.

Still an object of this invention is to provide a confinement of the steam and vapor so that they are directed to a controlled exit in order to enter a condenser of the direct spray-type so that the plume which is the carrier of particulates is eliminated.

Further, an object of this invention is to provide a reservoir of adequate capacity for the containment of the condensate in order to make the conditions amenable to the dissolving of the condensables resulting from the quench.

Yet, an object of this invention is to provide a high energy scrubber of relatively small volumetric capacity to scrub the non-condensables which leave said reservoir after condensation takes place in order to prevent the non-condensables from carrying particulates and disperse them into the atmosphere, these particulates being small in size and mostly sub-micron.

Further yet, an object of this invention is to provide an apparatus having storage means at the bottom thereof for the collection of excess water and particulate matter such as breeze washed from the coke during the quenching operation and adapted to collect such excess water and breeze without causing interference to operation, the generation of breeze being an inherent factor in coke making.

It is further yet, an object of this invention to provide a swinging-blade means within said chamber to spread the coke as it is pushed into said chamber in order to distribute said coke within said chamber while the coke is water-sprayed in order to cool the coke and simultaneously spread it so that the coke is quenched in layers with maximum surface exposure.

Therefore, another object of this invention is to provide a guide means equipped with sprays in order to abate smoke while the coke is in the guide and to direct the sprays toward the direction of the push in order to create a negative draft within said guide and at the same time clear the guide of coke in the area where the ram of the pusher has no access after the completion of the push.

Further, another object of this invention is to make the guide part of said quenching car and provide said guide with articulated features in order to swing towards the oven to be pushed and fold away from the oven after the push, such swinging guide making possible the relieving of the load on the coke side bench and also liberating the door-extractor during the push.

Further yet, another object of this invention is to provide a self-contained car for the pushing and quenching of coke which is retro-fitted to existing conditions of the coke side of conventional batteries and having a carriage to make it moveable from point to point, an enclosed guide which is adapted to swing and move towards the oven to be pushed, a quenching chamber having sloped bottoms equipped with discharge gates, excess water diverting plates which are rotatable co-acting with said gates, duct means for directing the steam and vapor into a condensing means, and wherein said guide means interconnects the oven to be pushed to said chamber and said chamber to said condensing means, water storage means equipped with pumps to furnish water under pressure for quenching and condensing, means to eliminate oxygen from entering said chamber provided by seals and positive pressure, means to eliminate the plume which is a carrier of particulates, means to spread the coke within said chamber and at the same time spray the coke to drop the temperature thereof below its ignition point, means to contain excess quench water and condensate, and means guaranteeing the proper flow of hot and cold water within said water storage means in order to provide efficient condensation.

It is still further another object of this invention to provide a carriage support means disposed to said chamber for the movement of said guide and incorporating trunion means for mounting said guide to said supporting carriage in order to impart an elevating or a depressing motion to said guide for compensating changes in elevation of the running track to make possible for proper alignment with the level of the oven to be pushed irrespective of the running track condition.

It is further yet, another object of this invention to provide seals to the joints of said guide means and said chamber, and said gate means and said chamber, in order to substantially seal said chamber and keep oxygen out, said seals being preferably of reinforced belting such as Plylon as made by the Goodyear Rubber Company, which belting is kept cool by water sprays; also the sealing of said guide opening is done by the body of coke proper with an overhead baffle in the form of a pendulum closing the channel opening above the coke line.

It is still further yet, another object of this invention to provide heat exchanging means in order to recover heat from said condensate which is appreciably hot, said heat exchanging taking place in heat exchanging units such as shell and tube and increasing the temperature of water such as boiler make-up water and decreasing the temperature of the condensate.

Other objects of this invention will appear from the following detailed description and appended claims.

Reference is made to the accompanying drawings forming a part of this specification wherein like reference characters designate corresponding parts in the views.

Figures 1, 2, 3, 4, 5, 6, 7, 8:
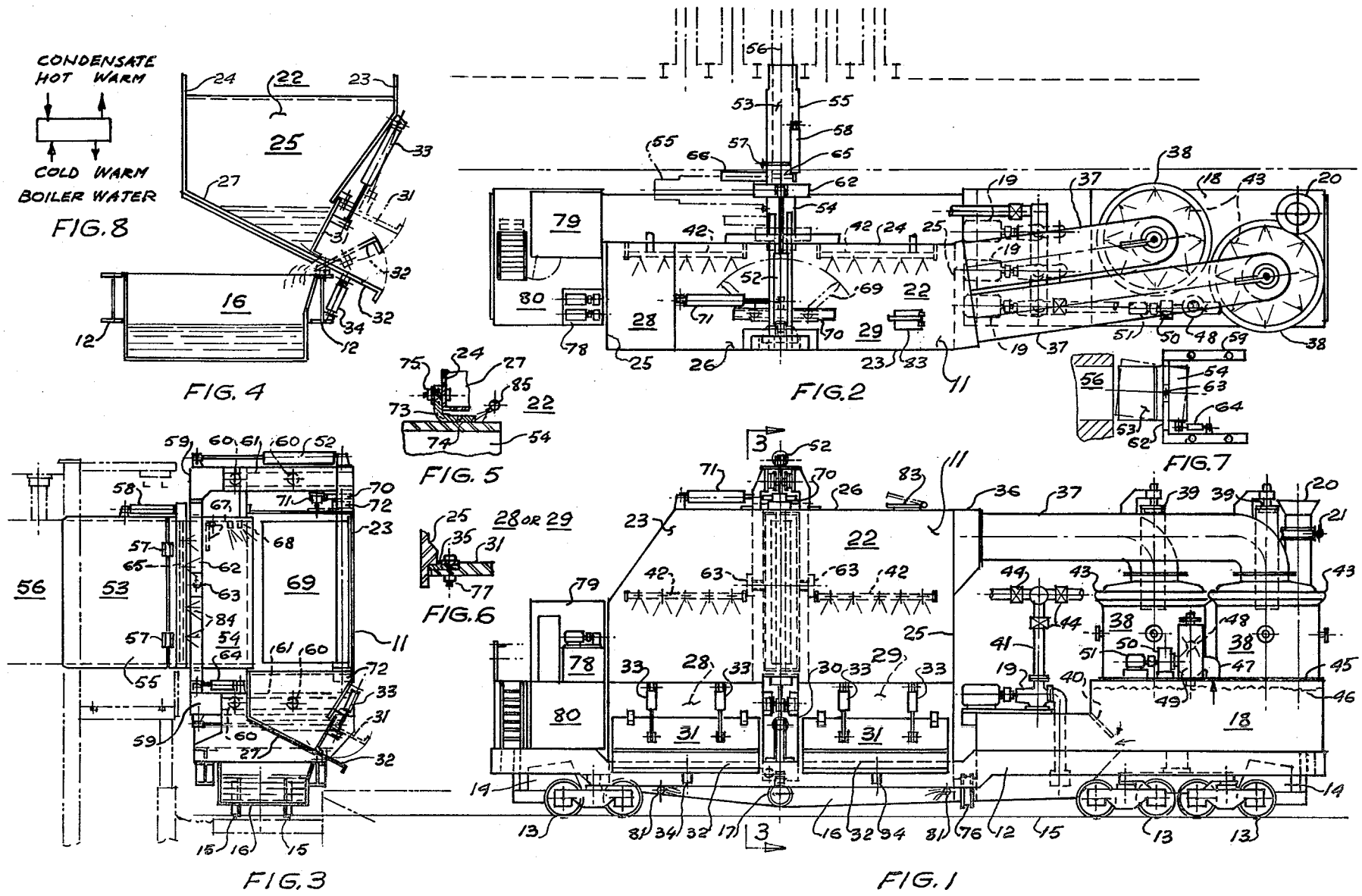
FIG. 1 is a front elevation of the invention.
FIG. 2 is a plan view of the invention.
FIG. 3 is a side view of the invention in section taken at 3—3 of FIG. 1.
FIG. 4 is a partial side view in section, showing the tank means for foul water and discharge gate means with a baffle for directing water from the quenching chamber to the tank.
FIG. 5 is a partial view in section showing the sealing arrangement between the chamber and guide means.
FIG. 6 is a partial view in section showing the sealing arrangement between the chamber and gate means.
FIG. 7 is a representation showing the pivoting of the guide means for compensating in the level of the guide to take care of irregularities of running track.
FIG. 8 is a schematic view showing heat recovery from the quench water for energy conservation.

Before explaining in detail the present invention, it is to be understood that the invention is not limited to its application and to the details of construction and arrangement of the parts illustrated in the accompanying drawings since the invention is capable of other embodiments. Also, it is to be understood that the phraseology or terminology herein is for the purpose of description and not limitation.

DETAILED DESCRIPTION OF DRAWINGS

In the drawings and referring to FIG. 1, 11 indicates the improved coke quenching car. It possesses base 12 mounted on wheeled trucks 13 which are adapted to run on rails 15 driven by motors 14 in order to form a moveable carriage. Base 12 is made of longitudinal girders with the space in between occupied by excess water tank 16. Excess water tank 16 is made with a sloped bottom towards the center of base 12 for drainage purposes and valve 17 is disposed in order to empty the excess water, the breeze and the precipitated particulate matter. In order to prevent the settling of breeze and particulate matter in tank 16 flushing jets 81 adapted to spray water under pressure are used during the emptying of tank 16.

Rising from base 12, water tank 18 is disposed over multiple trucks 13 in order to stabilize the weight of car 11. Pumps 19 are mounted on tank 18 in such a way in order to obviate the necessity of priming them and they are connected to distribute water to the various sprays located in the components of car 11. Standpipe 20 is made an integral part of tank 18 for the filling thereof and it possesses damper 21 to seal tank 18 from the atmosphere. The level of the water of the tank is maintained by a level control (not shown). Tank 18 possesses a drain controlled by valve 76.

A quenching chamber denoted by numeral 22 extends upwardly from base 12 to form an enclosure for the reception of the coke. Chamber 22 is made up of longitudinal side 23 which is away from the battery and side 24 which is towards the battery. Sides 23 and 24 are bridged by ends 25. A top 26 closes the upper part of chamber 22 and inclined bottom 27 closes the bottom of chamber 22. Preferably bottom 27 is divided into two sections 28 and 29 and separated by central structure 30. Sections 28 and 29 are equipped with gates 31. As shown in detail in FIGS. 1 and 4, gates 31 are operated by actuating means 33, and flappers 32 operated by actuating means 34, direct the excess water from bottom 27 to tank 16. In the feeding of the coke onto the wharf after the completion of the quenching operation, gates 31 open to the dotted position and flappers 32 to the solid position as shown by FIG. 4 in order to provide a continuous inclined plane for the sliding of the coke from quenching car 11. Gate 31 is equipped with seal 35 around its periphery for sealing sections 28 and 29 and make them water tight. In the upper corner of chamber 22, aperature 36 is provided for the outlet of the steam which is generated by the quench and duct means 37 directs the steam from chamber 22 to condenser means 38, preferably a plurality of units of the direct contact type using the co-current spraying pattern. Condenser means 38, are mounted directly on top of tank 18 in order to directly discharge the condensate into tank 18. Relief breathers 39 are provided in condenser means 38 to dispel air at the beginning of the quenching cycle. The location of the suction of pumps 19 and the discharge from condenser means 38 are so placed on top of tank 18 in order to insure cold water being withdrawn for the quenching and condensing and the condensate being discharged away from the suction; baffle 40 adds to the insurance of proper circulation. Piping system 41 rises from pumps 19 to distribute water to quenching sprays 42 and condensing sprays 43. Proper valving 44 is incorporated in piping system 41 to discriminately pipe water to the various components of car 11. Condenser means 38 may possess perforated bottom plate 45 for uniform condensate distribution into tank 18 or may be provided with a discharge leg. The non-condensables which bubble from condensate level 46, are sucked in riser 47. Riser 47 is connected to high energy venturi scrubber 48 which is attached to a cyclone de-mister 49. The draft for the scrubber is provided by fan 50 driven by motor 51. Scrubber water is taken from tank 18 and discharged back into it after scrubbing.

Above central structure 30 guide 53 shown on FIGS. 1, 2 & 3 is provided and is equipped with actuating means 52 in order to move the guide towards and away from the oven to be pushed. Preferably guide 53 is made up of two sections 54 and 55. Section 55 being adapted to articulate, preferably 90°, towards the ovens for pushing and towards quenching car 11 when quenching car 11 travels to discharge and take water or to dump the coke onto the wharf. Coke guide 53 which is made up of sections 54 and 55, interconnects the oven to be pushed shown by numeral 56, to chamber 22 to receive the coke from oven 56. Chamber 22 is equipped with sprays 42 which have the capacity to flood chamber 22 with water supplied by pumps 19. Sprays 42 preferably located, to spray sections 28 and 29 from above, use the type of nozzles that spray floods of water for maximum coverage.

Referring to FIGS. 2 & 3, sections 28 and 29 of chamber 22 receive the coke from guide 53 which is against oven 56. Guide 53 is divided into two parts, the straight part 54 and the articulated part 55, articulated part 55 being shown in solid against the oven and in phantom in the folded position. Actuator 52 moves guide 53 to and from the oven and section 55 thereof swings about pivot 57 and actuator 58 causes the swing about pivot 57. Guide 53 is supported by carriage means 59 for proper support of guide 53. Carriage means 59 equipped with wheels 60 is channeled in track 61 for guidance and support and is made-up of frame 62 having the shape of a horse shoe with its opening facing opposite the battery. Frame 62 possesses two trunion supports 63 for pivotally mounting straight part 54 of guide 53; articulated part 55 is in turn pivotally mounted to straight part 54 by means of pivot 57 as already stated. The articulation of straight part 54 about trunion supports 63 is caused by actuator 64 as shown by FIG. 7, this being provided to adjust the elevation of guide 53 to compensate for irregularities in the running track for car 11. Gate 65 in the form of a guillotine is provided to block the end of straight part 54 after the push, the movement of guillotine 65 being performed by actuator 66. Within straight part 54 of guide 53, at the top part thereof, a swingeable baffle 67 is provided to block the channel above the coke line. Baffle 67 is made long enough to ride on top of the coke as the coke is being pushed. Sprays 68 which are directed towards the direction of the push of the coke serve to create a negative draft within the guide at the beginning of the push and within guillotine 65 water sprays are provided in order to drop the temperature of the coke contained in straight part 54 of guide 53 after the push is completed, the coke contained in straight part 54 normally being inaccessible to the ram of the pusher which is not shown, these guillotine sprays are numbered 84.

Sections 28 and 29 are preferably separated by central portion 30 and swinging blade 69, operated by rack and segmental gear means 70 actuated by cylinder 71, imparts an oscillating motion about pivot 72 to swinging blade 69 and thereby spread the coke into sections 28 and 29. It is contemplated to give several oscillatory cycles to blade 69 during the push of the coke in order to lay the coke in layers and maximize the spraying of the layers by means of sprays 42 for the greatest surface exposure to water. Pressure relief damper 83 opens to atmosphere for safety.

Referring to FIG. 5, seal 73 is provided between clearance 74 at entry of chamber 22 for straight part 54 of guide 53; seal 73 is preferably bolted in place by fastening means 75. Referring to FIG. 6, seal 35 is provided to seal coke discharge gate 31 against either section 28 or 29; seal 35 is also preferably bolted in place by fastening means 77. The maintaining of positive pressure within chamber 22 to keep oxygen out and to render the method of quenching more efficient than by spreading the coke with blade 69 is accomplished by sealing chamber 22 and by under-sizing ducts 37 slightly.

Quenching car 11 is also equipped with a hydraulic power pack 78 made-up of pumps, tank and valves. The operation of car 11 is carried out from cab 79 and the controls are housed in electrical room 80.

Cab 79 is air-conditioned and room 80 is under positive pressure to keep dust out. Since the cost of energy is increasing from day to day, it is imperative not to pull air over hot coke in order to prevent burning which results in loss of yield, and since the condensate results in high temperature, possibly as high as 185° F., it is intended to recover this heat. For this reason a heat exchanging means such as a shell and tube is proposed for heat recovery, FIG. 8. In a coke plant, boiler make-up water is always added since there are losses of steam at all times. As for example at the Lackawana Plant of Bethlehem Steel, 60% of the boiler water has to be made-up. Heat from the condensate is to be used to raise the temperature of the make-up water. In new plants, water can be heated from the condensate, not only for the power house but also to heat buildings and so forth.

While the operation of the apparatus of the present invention may be comprehended from a study of the foregoing description, it is believed that the operation may be further explained as hereinafter set forth:

OPERATION

Referring to the drawings, car 11 is driven to a water filling station located somewhere along the battery preferably next to the present quenching sumps and tank 18 filled with water. Its capacity is good for at least one quench. After the filling, the operator in cab 79 moves car 11 so chamber 22's center line is opposite oven 56 which is to be pushed. The door extractor, which is not shown and is not part of this invention, extracts the door from oven 56 and articulated section 55 of guide 53 is rotated from its folded position to be in line with oven 56 by means of actuator 58. Guide 53 is then propelled forward against the jamb of oven 56 while rolling on carriage 59, the forward movement being effected by actuator 52, and the leveling of guide 53 is preferably automatic. A signal is transmitted from the pusher operator (not shown) to the quenching car operator in cab 79, that the push is ready to commence.

Upon receipt of such signal the operator from cab 79, starts water pumps 19 to circulate water. He then actuates valving means to spray water in guide 54 in order to create a negative draft therein and when hot coke pushes baffle 67, sprays 42 in chamber 22 and sprays 43 in condensers 38 which sprays are of great capacity, are automatically turned on and oscillating blade 69 begins its swing. It is to be noted that guide 53 and chamber 22 are completely enclosed to provide a non-oxidizing atmosphere. As the coke is pushed into chamber 22 the swinging blade sweeps the coke from the exit end of straight part 54 of guide 53 and spreads it into either section 28 or 29 and simultaneously with this spreading action, the coke is sprayed so that the cooling of the coke is effected in layers, since several oscillatory cycles occur during a single push. Further via, the permeation of steam through the coke as it rises and the maintenance of a positive pressure within chamber 22, coke is very efficiently quenched. At the initial generation of steam, the steam expands and pushes the air from chamber 22 towards condensers 38 and is exhausted through relief breathers 39. Once condensing starts taking place breathers 39 close and a vacuum condition occurs in condensers 38. It is the intent to operate chamber 22 under a slight positive pressure to keep oxygen out; this is accomplished by keeping chamber 22 substantially sealed and under-sizing ducts 37. Condensers 38 will be operated under a slight vacuum. By having this arrangement steam is pushed into ducts 37 and condenser 38, while the vacuum in condensers 38 do some pulling of steam into them. As the great quantities of water are sprayed in condensers 38, the steam is condensed and runs down into tank 18 as condensate. It is preferred to size condensers 38 to fully condense the steam. The pushing of coke, the quenching of the coke, the condensing of the steam and the scrubbing of non-condensables are substantially simultaneous once the purging of the air takes place. The taking of water by pumps 19 from tank 18 and the discharge of condensate from condensers 38 are so arranged as to prevent the pumping of hot water in order to insure proper water temperature for condensation.

Since the condensables dissolve in the condensate and since steam is condensed, there is no carrier for particulate matter except for the very small volume of non-condensables generated by the quench. These non-condensables tend to leave the condensate and carry with them particulate matter and for this reason, tank 18 is closed to the atmosphere and standpipe 47 is provided as an outlet for the non-condensables which are directed to venturi scrubber 48 where they are scrubbed at a venturi throat having a pressure drop of about 80 inches and the water entrainment is removed by cyclone de-mister 49. The suction for the scrubbing system being provided by fan 50 driven by motor 51.

Guillotine gate 65 is located on straight part 54 of guide 53, in such a way that the ram of the pusher (not shown) travels through articulated part 55 and partly into straight part 54 beyond guillotine gate 65, so that no coke is in the way when closing guillotine gate 65.

Upon completion of the stroke of the ram of the pusher (not shown), the pusher operator retracts the ram from guide 53 and informs, by radio control, the operator of quenching car 11, that the push is completed. At this point, the operator of car 11, by means of actuator 66 closes guillotine gate 65. Water sprays 42 are shut off and water sprays 68 within straight part 54 of guide 53 and water sprays 84 within guillotine gate 65 are turned on to drop the temperature of the coke remaining within straight part 54 of guide 53. This remaining coke portion is either pushed into chamber 22 by the water sprays or by coke from the subsequent push. Following the closure of guillotine 65, swinging blade 69 is stopped and returned to its "zero position", guide 53 is retracted from oven 56 by actuation of cylinder 52, and articulated part 55 is swung to its folded position. At this juncture, car 11 is in position to travel to dump the foul water and condensate and receive fresh water for the following cycle and subsequently dump the quenched coke onto the wharf. Depending upon the location of the wharf in relation to the oven pushed and depending upon the water and dumping and filling station, the coke may be dumped first and then the foul water. Assuming that the dumping and filling of water takes place first, car 11 positions itself at the station and valves 17 and 76 opened, the foul water and condensate are discharged and fresh water is introduced through fill pipe 20, some fresh water is permitted to flow through tanks 18 and 16 in order to wash the breeze and particulates in the tanks and scouring nozzles are activated to further wash tank 16, if necessary, after valve 76 is closed. Once tank 18 is full and valve 17 closed, car 11 travels to the wharf for the dumping of the coke. Actuators 34 pull flappers 32 from the position shown in phantom to the position shown in solid and actuators 33 open gates 31, so that bottom 27 of chamber 22 and flappers 32 form a continuous inclined plane for the sliding of the coke onto the wharf. If during quenching excess water is sprayed on the coke, at the conclusion of the quench, gates 31 are cracked open to divert water into tank 16 making use of flappers 32 as shown by FIG. 4. Once the coke is onto the wharf, gates 31 close, flappers 32 are tilted upward and car 11 is ready to travel to another oven to catch a push.

In order to protect seals 73 during the quench they are either sprayed by special sprays 85 as shown by FIG. 5, or by the oscillation of swinging blade 69 throwing water against seals 73 as it swings under sprays 42.

The foul water and condensate are dumped into a series of basins for large particulate removal, thence to either a cooling tower or better yet to a heat exchanging unit as shown by FIG. 8. Great quantities of heat are transferred from the hot coke to the condensate and it is a worthwhile amount of heat to be recovered.

All in all it is submitted that the method and apparatus described for controlling emissions during the pushing and quenching of coke and for the conservation of energy, are capable of performing in an efficient manner with a minimum use of energy, smallest investment and least manpower, and at the same time providing dependable availability which the industry urgently needs. Both the method and apparatus can be installed without civil engineering so that retro-fitting in existing facilities is made possible in a practical and expeditious manner.

I claim:

1. Apparatus for controlling pollutions during the pushing of coke from a coke oven having a pusher side and a coke discharge opening, said apparatus comprising a carriage, means for moving said carriage into a selected position with respect to the coke discharge opening of the coke oven, a chamber supported by said carriage, said chamber including inlet means for receiving coke which is pushed through the discharge opening of the coke oven, quenching means for directing fluid into said chamber for dropping the temperature of the coke in the chamber, said fluid having properties such that in dropping the temperature of the coke it generates steam and vapors, a relatively narrow opening having an inlet side communicating with said chamber, said chamber designed to confine steam and vapors generated from the quenching of coke for creating and maintaining a positive pressure therewithin for forcing steam and vapors through said narrow opening, a condenser supported by said carriage, said condenser comprising a receptacle for receiving and confining a body of fluid, said condenser having an inlet in fluid communication with the outlet side of said narrow opening, means for creating a slight negative draft in said condenser as coke is being pushed into said chamber, whereby steam and vapors forced out of said narrow opening is directed to said condenser, and means for directing fluid into said condenser at the steam and vapor in said condenser for condensing steam and vapor directed to said condenser.

2. Apparatus as defined in claim 1 including means carried by said carriage for collecting fluid used to quench the coke in said chamber and for collecting the fluid used to condense the steam and vapors.

3. Apparatus as defined in claim 2 wherein said means for collecting fluid used to condense the steam and vapors comprises tank which is closed to atmosphere, means carried by said carriage for drawing non-condensable gases from said tank and for cleaning said non-condensable gases.

4. A method of controlling pollutions during the pushing of coke from a coke oven having a pusher side and a coke discharge opening, said method comprising the steps of providing a carriage having a chamber, moving the carriage into a selected position with respect to the coke oven to position the inlet of the chamber in alignment with the discharge opening of the coke oven, pushing coke through the discharge opening of the coke oven and into the chamber, directing fluid into the chamber for dropping the temperature of the coke in the chamber and for generating steam and vapors, confining steam and vapors generated from the quenching of coke within the chamber for creating and maintaining a positive pressure within the chamber and for forcing steam and vapors through a narrow opening having an inlet communicating with the chamber, providing a condenser on the carriage in the form of a receptacle for receiving and confining a body of fluid therein and having an inlet in fluid communication with the outlet side of the narrow opening, creating a slight negative draft in said condenser as coke is being pushed into the chamber, whereby steam forced out of said narrow opening is directed to said condenser, and directing fluid into the condenser at the steam and vapor in said condenser for condensing steam and vapor directed to the condenser.

* * * * *